US006318587B1

(12) United States Patent
Friederich

(10) Patent No.: US 6,318,587 B1
(45) Date of Patent: Nov. 20, 2001

(54) DEVICE FOR CLOSING DRINKING CONTAINERS OF VARYING SIZE

(76) Inventor: Rüdiger Friederich, Dunantstrasse 5, D-75031 Eppingen (DE)

( * ) Notice: Subject to any disclaimer, the term of this patent is extended or adjusted under 35 U.S.C. 154(b) by 0 days.

(21) Appl. No.: 09/508,124

(22) PCT Filed: Jun. 3, 1998

(86) PCT No.: PCT/DE98/01509

§ 371 Date: Mar. 6, 2000

§ 102(e) Date: Mar. 6, 2000

(87) PCT Pub. No.: WO99/20162

PCT Pub. Date: Apr. 29, 1999

(30) Foreign Application Priority Data

Oct. 21, 1997 (DE) ..... 197 46 465

(51) Int. Cl.[7] ..... B65D 51/04

(52) U.S. Cl. ..... 220/845; 220/848; 220/287; 220/262; 220/730

(58) Field of Search ..... 215/386; 220/730, 220/731, 200, 262, 287, 845, 848, 810, 811, 263, 700, 701; 222/470

(56) References Cited

U.S. PATENT DOCUMENTS

| | | | | |
|---|---|---|---|---|
| 184,758 | * | 11/1876 | Clements | 220/845 |
| 210,042 | * | 11/1878 | Laughlin | 220/845 |
| 219,539 | * | 9/1879 | Stevens | 220/845 |
| D. 288,891 | * | 3/1987 | Saito | 220/287 X |
| 515,069 | * | 2/1894 | Assorati | 215/386 X |
| 645,121 | * | 3/1900 | Oldenbusch | 220/810 |
| 1,113,119 | * | 10/1914 | Hoefer | 215/386 X |
| 1,291,284 | * | 1/1919 | Valent | 215/386 |
| 1,312,554 | * | 8/1919 | Johnson | 215/386 X |
| 1,417,282 | * | 5/1922 | Senio | 215/386 X |
| 1,442,652 | * | 1/1923 | Culver | 215/386 X |
| 1,602,195 | * | 10/1926 | Harrold | 215/386 |
| 1,733,807 | * | 10/1929 | Landes | 215/386 X |
| 1,850,606 | * | 3/1932 | Smith | 220/200 |
| 2,031,892 | * | 2/1936 | Johnson | 215/386 X |
| 2,314,607 | * | 3/1943 | Clark | 215/386 |
| 2,552,397 | * | 5/1951 | Bretney | 222/470 |
| 2,744,631 | * | 5/1956 | Toombs | 215/386 X |
| 2,760,672 | * | 8/1956 | Cronheim | 220/287 |
| 3,130,856 | * | 4/1964 | Gits | 220/200 |
| 3,871,547 | * | 3/1975 | Wharton | 220/200 X |
| 4,555,034 | | 11/1985 | Gerhards . | |
| 5,555,994 | * | 9/1996 | Chen | 220/287 |
| 5,695,086 | * | 12/1997 | Viola | 220/287 |
| 5,720,408 | * | 2/1998 | Schmid et al. | 220/287 |
| 5,739,758 | * | 4/1998 | Driska et al. | 220/263 X |
| 5,944,238 | * | 8/1999 | Stark | 220/287 X |

FOREIGN PATENT DOCUMENTS

| | | |
|---|---|---|
| 43 25 925 A1 | 2/1995 | (DE) . |
| 44 33 400 A1 | 3/1996 | (DE) . |
| 296 00 246 U1 | 4/1996 | (DE) . |
| 297 18 814 U1 | 2/1998 | (DE) . |
| 23128 | 12/1915 | (GB) . |

* cited by examiner

*Primary Examiner*—Allan N. Shoap
*Assistant Examiner*—Robin Hylton
(74) *Attorney, Agent, or Firm*—Alston & Bird LLP

(57) ABSTRACT

Closing device for a container, in particular a drinking glass, having a lid (2) adapted for pivoting about a pivotal axle (13), a fastening arrangement (3) for securing the pivotal axle (13) relative to the container, and a connector (4) connected to the lid (2) and the pivotal axle (13). The connector (4) is displaceable with respect to the pivotal axle (13), thereby permitting adjustment of the spacing between the pivotal axle (13) and the lid (2) in the direction of the connector (4).

15 Claims, 2 Drawing Sheets

DEVICE FOR CLOSING DRINKING CONTAINERS OF VARYING SIZE

BACKGROUND OF THE INVENTION

The invention relates to a device for closing a container, in particular a drinking glass, with a lid adapted for pivoting about a pivotal axle, a fastening arrangement for securing the pivotal axle with respect to the container, and a connector that connects to the lid and the pivotal axle.

Such a closing device is known from DE 296 00 246 U1. The closing device described therein is used to cover a drinking glass. The closing device is placed onto the drinking glass with a clamp serving as a fastening means to the upper rim, and the lid can be swung upward from its horizontal position on the drinking glass by means of a lever that is actuatable with a finger. On its one side, the lid connects to the lever via a connector. This closing device has the disadvantage that the lid and its position on the drinking glass cannot be adapted to different types of drinking glasses. Consequently, it is necessary to produce a different closing device for each type of drinking glass. Likewise, the use of the closing device for different drinking glass sizes is not provided because of the permanently predetermined position of the pivotal axle.

It is the object of the invention to improve a closing device of the initially described kind in such a manner that the closing device is adaptable to different sizes or types of glasses.

SUMMARY OF THE INVENTION

The above and other objects and advantages of the present invention are achieved by a closing device for a container which comprises a lid, and a connector connected to the lid. A pivotal axle is secured to the connector by a fastening arrangement which permits the connector to be displaceable with respect to the pivotal axle along the length direction of the connector. Thus adjustment of the spacing between the pivotal axle and the lid in the direction of the connector is permitted.

In accordance with the invention, it has been recognized that the horizontal displacement of the lid is needed for adapting it to common glass diameters. This permits likewise a centering of the lid in the glass center, primarily when the upper rim slants inwards, as in the case of, for example, a wheat beer glass. Advantageously, it is possible to adapt the closing device to the common glass sizes from 0.2 to 0.5 liters. Likewise, due to its adjustability parallel to the connector, the closing device is adaptable to uncommon container shapes, such as angular or oval types of drinking glasses. The optimal positioning of the lid on the container permits a tight sealing of the lid all around.

Preferably, the connector extends substantially horizontally, when the lid is closed. As a result, the lid is horizontally adjustable in its position relative to the container. Since the lid is displaceable with the connector relative to the pivotal axle, the displacement motion of the lid occurs exclusively in the horizontal direction. On its end projecting beyond the pivotal axle, the connector mounts an operating handle for raising the lid from the upper rim of the container. In this end region of the connector, the latter can be bent upward, thereby creating an offset lever action, so that the lid does not extend too far out when being raised. This reduces a risk of injuring the face of the operator, when the lid is opened.

In a further development of the invention, the pivotal axle comprises in particular an axial slot, which supports the connector for displacement. Advantageously, the pivotal axle is constructed as a pin, which is openly supported between two arms projecting from the fastening arrangement. In the open region, a slot is provided, through which the connector extends. Thus, the connector is displaceable in a simple manner in the slot of the pivotal axle.

In another further development of the invention, the connector is designed and constructed in the form of a bow with two parallel side arms, between which the pivotal axle is mounted for displacement. In this arrangement, the pivotal axle that is designed and constructed as a pin is supported in a bore of one arm of the fastening arrangement. The ends of the pin projecting laterally from the bore of the arm contain each a groove, into which the two lateral arms of the connector can be clipped. This permits a displacement of the pivotal axle along the connector in a simple manner.

Preferably, the connector with the lid is removable from the pivotal axle. This can occur in a first further development, in that the pin is laterally removable from the two arms and can be pulled off from the connector through the unilaterally open slot. In a second further development, the connector can be separated in a simple manner from the outer ends of the pin by a slight pressing, since the engagement between the connector and the pivotal axle is formfitting. In addition, it may be provided that the lid is removable from the connector.

In another further development of the invention, the pin is supported in a bore such that a clamping action prevents the lid from closing unintentionally. To this end, the bore may be made in particular oval, whereby the pin is clamped in the bore, and the lid is slightly braked. When the pin is likewise made oval, it is possible to define an engaging position in the open position of the lid. This prevents in an advantageous manner an unintentional closing of the lid.

The fastening arrangement preferably comprises a projecting arm connected to the pivotal axle and a free leg, on which the projecting arm is supported for displacement.

It has been recognized by the present invention that the pivotal axle mounted to the projecting arm can be displaced relative to the free leg by displacing the projecting arm. Advantageously, the shape of the free leg makes it possible to preadjust the change of position of the pivotal axle, when the projecting arm is displaced. In this instance, the free leg is arranged at a distance from the wall of the container, so that a displacement of the projecting arm is possible.

It is preferred to construct the fastening arrangement as a coiled clamp with two in particular parallel clamping legs that can be clamped to a wall of a container. In this arrangement, the free leg connects the two clamping legs, thereby forming a helicoidal clamp, which permits applying the closing device in a simple manner by clamping it to the wall of the container. The rounding of the coiled clamp in a lower region serves the easy removal of the closing device from the container, should the container have a reinforcement on its upper rim. In addition, the rounding in the lower region of the clamp facilitates likewise the placement of the fastening arrangement. As a result of its coiled shape, the clamp advantageously adapts itself to different wall thicknesses. Moreover, the rounding of the clamp in its lower region permits pressing it from the bottom upward, thereby preventing the lid from wobbling, when it is opened and closed. In addition, because of its rounded shape, the clamp is suited in particular for folding in order to carry the closing device, for example, in a pocket of a jacket.

In a first further development of the invention, the projecting arm comprises on its end facing away from the pivotal axle a holding means that surrounds the free leg at least in part. The holding means surrounds the free leg preferably on its two lateral edges and is easily displaceable therealong. In this manner, the free leg may be shaped irrespective of the holding means in accordance with any desired curve. Therefore, the holding means with the lid can be a mass product, which is adaptable to different clamps of the fastening arrangement.

On its free leg, the fastening arrangement may comprise at least one rail, along which the holding means is displaceable. The rail is placed outside on the free leg, and the holding element can be displaced along the rail.

Preferably, the projecting arm performs a substantially vertical movement, when it is displaced relative to the free leg, so that the lid is vertically adjustable. Furthermore, the fastening arrangement may comprise an arcuately curved free leg, so that when it is displaced, the projecting arm performs in addition a rotation relative to the inclination of the lid. This permits adapting the lid to drinking glasses, whose upper rim either tapers or is not parallel to the base of the container. Likewise, the rotation facilitates a displacement of the pivotal axle in the horizontal direction.

Preferably, the connector or the free leg of the fastening arrangement comprises a holding or clamping means to prevent unintentional displacement. The locking engagement also permits securing an optimal adjustment of the centering of the lid.

On its underside, the lid may also comprise concentric, annular recesses, which are used to position it on the upper rim of differently sized containers. The concentric recesses are configured such that the lid fits common drinking glass sizes between 0.2 and 1 liter, so that the lid sealably lies on the upper rim of the particular drinking glass. This makes it possible to center the lid advantageously on the upper rim of drinking glass.

Preferably, the lid is used as a carrier of advertisements or information. It is possible to print advertising surfaces both inside and outside of the lid. Holographs or advertisements can be inserted in a box in the lid. Likewise, the lever for actuating lid, namely opening the lid, may be provided, for example, with a symbol of a ladybug.

The closing device may also comprise a noise module, which generates sounds or noises, when the lid is opened. The lid may be adapted such that the container amplifies the sounds or noises as a resonant body.

BRIEF DESCRIPTION OF THE DRAWINGS

Some of the objects and advantages of the present invention having been stated, others will appear as the description proceeds, when considered in conjunction with the accompanying drawings, in which.

DETAILED DESCRIPTION OF THE PREFERRED EMBODIMENTS

Figure 1:
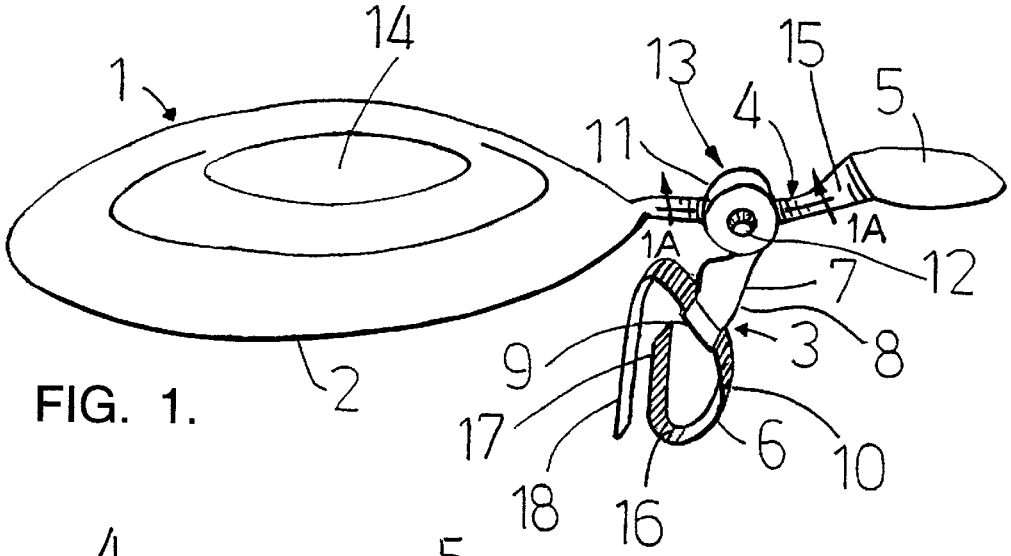
FIG. 1 is a perspective view of the closing device of the present invention according to a first embodiment.

A closing device 1 comprises a lid 2, a fastening arrangement 3, and a connector 4 connected to the lid. The end of connector 4 opposite to the lid 2 mounts an operating element 5. The fastening arrangement 3 comprises a coiled clamp 6 and a projecting arm 7. At its first end 8, the projecting arm 7 mounts a holding means 9, which partially surrounds a free leg 10 of the coiled clamp 6. At its second end 11, the projecting arm 7 mounts a pivotal axle 13 constructed as a pin 12.

When viewed from the top, the lid 2 has a convex shape with a surface 14 for printing thereon advertisements or information. The connector 4 extends substantially horizontally, with the operating element 5 being elevated relative to the connector 4 by an upward sloping connecting member 15. The connector 4 and the coiled clamp 6 are provided with grooves 16 to prevent an unintentional displacement.

Figure 1A:
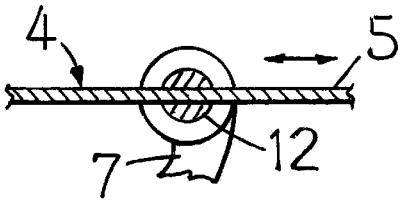
FIG. 1A is a fragmentary sectional view taken along the line 1A—1A in FIG. 1.

The operating element 5 can be pushed downward in the vertical direction, so that the lid 2 can pivot from a horizontally lying position on the container upward about the pivotal axle 13. As best seen in FIG. 1A, the pivotal axle 13 is designed and constructed as a pin 12 with an axis parallel slot, through which the connector 4 extends, and which enables a displacement parallel to the orientation of connector 4. When the connector 4 is horizontally aligned, it is possible to center the lid relative to the container in the horizontal direction. However, the connector may also have a slope, which enables both a horizontal and a vertical adjustment of the lid 2.

The coiled clamp 6 comprises two parallel clamping legs 17 and 18, between which the upper rim of a container can be clamped. The clamping legs 17 and 18 are connected by a free leg 10, which has a curved shape. By displacing the projecting arm 7 along the free leg 10, it is possible to adjust the lid 2, on the one hand in the vertical direction and on the other hand in its inclination relative to the upper rim of the container. In addition, with a corresponding design and construction of the free leg 10, it is also possible to attain a horizontal displacement of the pivotal axle 13.

Figure 2:
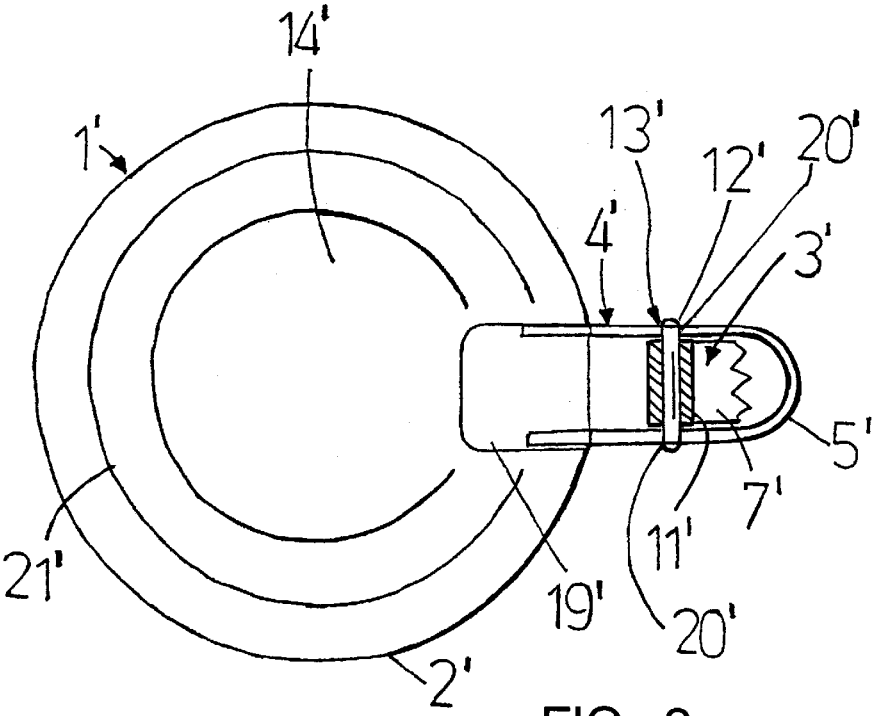
FIG. 2 is a bottom view of the closing device of the present invention according to a second embodiment.

FIG. 2 illustrates a closing device 1' according to a second embodiment. Unlike the foregoing embodiment, this embodiment comprises a connector 4' designed and constructed as a bow with two parallel side arms. The side arms of connector 4' are made of metal and mounted with their ends in a recess 19' of the lid by means of a clamping engagement and/or an adhesive connection.

The pivotal axle 13' is designed and constructed as a pin 12', which is supported in a bore of the projecting arm 7' of fastening arrangement 3'. With its two ends, the pin 12' extends laterally beyond the projecting arm 7', and is adapted for engaging the two parallel side arms of connector 4' respectively via a groove 20'.

The inner side of the lid 2' is provided with concentric, annular grooves, which fit together with the upper rim of different containers, so that the lid 2' is able to lie optimally and sealingly on the upper rim and can be used for different container types. The concentric grooves 21' extend between annular, concentric ribs.

Figure 3:
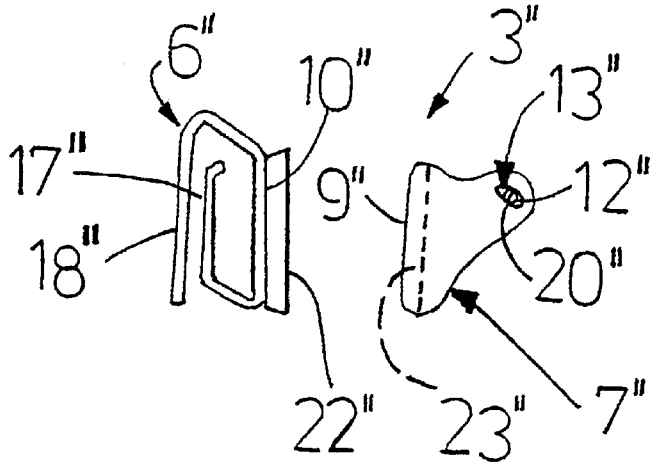
FIG. 3 is an exploded view of a fastening arrangement according to a third embodiment of the invention.

FIG. 3 shows a fastening arrangement 3" of a third embodiment. A coiled clamp 6" comprises two clamping legs 17", 18" and a free leg 10" that mounts a cross sectionally trapezoidal rail 22" on its free side. A projecting arm 7" that can be connected to the coiled clamp 6", and is displaceable along rail 22", has the shape of a shoe. On its side facing the coiled clamp 6", the projecting arm 7" contains a recess 23" mating with rail 22", which enables the projecting arm 7" to move along rail 22" in vertical direction, i.e., parallel to the upper rim of the container.

Figure 4:
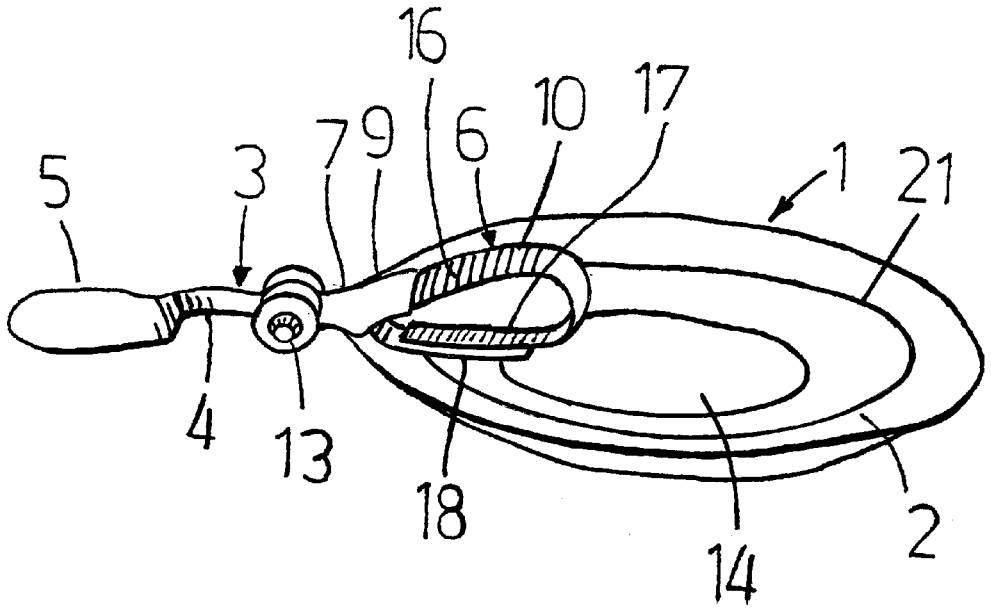
FIG. 4 is a perspective view of the closing device of FIG. 1 in a position of transportation.

FIG. 4 illustrates the closing device 1 in its position of transportation. In this instance, the fastening arrangement 3 lies with its projecting arm 7 and coiled clamp 6 against the inner side of the lid 2. The coiled clamp 6 is turned in holding means 9 to a position, in which the coiled clamp 6 has a small height relative to the contact surface on the lid 2. This permits folding the closing device 1 flat and transporting it, for example, in a shirt pocket. An annular groove as described above is illustrated at 21 in this figure.

What is claimed is:

1. A closing device for a container comprising, a lid connected to a pivotal axle, and a fastening arrangement for securing the pivotal axle to the container comprising a projecting arm connected to the pivotal axle, and a retaining device configured for removable attachment to an upper rim of the container and including a free leg, with said projecting arm being mounted for sliding displacement along said free leg, and with the retaining device further including a coiled clamp having two parallel clamping legs that can be clamped to a wall of the container.

2. The closing device of claim 1, wherein the free leg connects between the two clamping legs.

3. A closing device for a container comprising a lid connected to a pivotal axle, and a fastening arrangement for securing the pivotal axle to the container and comprising a projecting arm connected to the pivotal axle, and a retaining device configured for removable attachment to an upper rim of the container and including a free leg, with said projecting arm being mounted for sliding displacement along said free leg, and wherein the projecting arm comprises a holding means surrounding at least in part the free leg and is supported for displacement along the free leg.

4. A closing device for a container comprising a lid connected to a pivotal axle, and a fastening arrangement for securing the pivotal axle to the container and comprising a projecting arm connected to the pivotal axle, and a retaining device configured for removable attachment to an upper rim of the container and including a free leg, with said projecting arm being mounted for sliding displacement along said free leg, and wherein during use, the free leg is oriented along a direction having a vertical component, and so that during its displacement the projecting arm performs a movement which includes a vertical component and so that the lid height is adjustable.

5. A closing device for a container comprising a lid connected to a pivotal axle, and a fastening arrangement for securing the pivotal axle to the container and comprising a projecting arm connected to the pivotal axle, and a retaining device configured for removable attachment to an upper rim of the container and including a free leg, with said projecting arm being mounted for sliding displacement along said free leg, and wherein the free leg is arcuately curved, so that during its displacement the projecting arm performs a rotation relative to the inclination of the lid.

6. A closing device for a container comprising a lid connected to a pivotal axle, and a fastening arrangement for securing the pivotal axle to the container and comprising a projecting arm connected to the pivotal axle, and a retaining device configured for removable attachment to an upper rim of the container and including a free leg, with said projecting arm being mounted for sliding displacement along said free leg, and wherein the lid comprises on its underside concentric annular grooves, with which the lid can be positioned on the upper rim of differently sized containers.

7. A closing device for a container comprising, a lid, a connector connected to the lid and having a length direction extending radially outwardly from the lid, a pivotal axle, and a fastening arrangement for securing the pivotal axle to the connector so that the connector is displaceable with respect to the pivotal axle in the length direction of the connector, thereby permitting adjustment of the spacing between the pivotal axle and the lid in the length direction of the connector.

8. The closing device of claim 7, wherein the connector extends substantially horizontally when the lid is closed on the container, thereby permitting horizontal adjustment of the lid in its position relative to the container.

9. The closing device of claim 7, wherein the pivotal axle includes an axial slot in which the connector is supported for displacement in the length direction.

10. The closing device of claim 7, wherein the connector is designed and constructed in the form of a bow with two parallel side arms, between which the pivotal axle is mounted for displacement in the length direction.

11. The closing device of claim 7, wherein the pivotal axle is removably secured to the connector.

12. The closing device of claim 7, wherein the pivotal axle comprises a pin which is supported in an oval bore so that a clamping effect prevents an unintentional closing of the lid.

13. The closing device of claim 7 further comprising a retaining device connected to the pivotal axle for removably attaching the closing device to an upper rim of the container.

14. The closing device of claim 13 wherein the retaining device comprises a pair of spaced apart, parallel clamping legs.

15. The closing device of claim 14 wherein the retaining device further comprises a projecting arm connected to the pivotal axle, a free leg connected between the pair of clamping legs, and with the projecting arm mounted for displacement along said free leg.

* * * * *